US005355763A

United States Patent [19]

Franklin et al.

[11] Patent Number: 5,355,763

[45] Date of Patent: Oct. 18, 1994

[54] PROPELLANT CASTING APPARATUS

[75] Inventors: Richard N. Franklin, Madison; Philip W. Schrack, Manassas, both of Va.

[73] Assignee: Atlantic Research Corporation, Fairfax, Va.

[21] Appl. No.: 407,369

[22] Filed: Sep. 14, 1989

[51] Int. Cl.[5] ..... F42B 33/02

[52] U.S. Cl. ..... 86/31; 86/1.1

[58] Field of Search ..... 86/1.1, 20.11, 29, 31, 86/33; 264/3.1

[56] References Cited

U.S. PATENT DOCUMENTS

| | | | |
|---|---|---|---|
| 2,150,913 | 3/1939 | Drew | 86/1.1 |
| 2,749,790 | 6/1956 | Miller | 86/29 |
| 2,939,176 | 6/1960 | Adelman | 264/3.1 |
| 3,807,272 | 4/1974 | Gray | 86/1.1 |
| 4,395,217 | 7/1983 | Benadi | 264/53 |
| 4,766,798 | 8/1988 | David et al. | 86/27 |

FOREIGN PATENT DOCUMENTS

| | | | |
|---|---|---|---|
| 108450 | 9/1917 | United Kingdom | 86/1.1 |

*Primary Examiner*—Stephen M. Johnson
*Attorney, Agent, or Firm*—Frank P. Presta

[57] ABSTRACT

A propellant casting apparatus for automatically filling rocket propulsion motors with semi-solid propellant is characterized by a unique propellant filling assembly which injects a precise given quantity of propellant into the motor from the bottom. The propellant filling assembly includes a chamber having an injection cylinder arranged at one end and a fill valve at the other. With the chamber filled with propellant, the fill valve is brought into engagement with the bottom of the motor and opened. The injection cylinder includes a piston which is extended into the chamber to inject propellant into the motor via the valve. The length of travel of the piston is accurately controlled to govern the precise quantity of propellant injected into the motor.

13 Claims, 3 Drawing Sheets

PROPELLANT CASTING APPARATUS

BACKGROUND OF THE INVENTION

The present invention relates to an apparatus for automatically filling rocket propulsion motors with a given quantity of semi-solid propellant. With the apparatus, a plurality of motors can be filled rapidly in succession without requiring any trimming or cleaning of excess propellant from the motors following the filling operation.

BRIEF DESCRIPTION OF THE PRIOR ART

Rocket motor propellant filling devices are well-known in the patented prior art as evidenced by the U.S. patent to Gray U.S. Pat. No. 3,807,272. In this device, rocket chambers are mounted on a rotary turntable, and each chamber is filled from the top by depositing a slurry of propellant therein. The chambers are filled while under vacuum to eliminate air bubbles in the propellant. Core rods are provided in the chamber which are removed following curing of the propellant to define bores in the chamber. The chambers are then further processed to form the rocket motors.

While the prior devices normally operate satisfactorily, they possess certain inherent drawbacks which limit their efficiency. For example, filling the rocket chambers with propellant from the top requires that the propellant must fall the length of the chamber which can cause folds in the propellant resulting in voids following cure. A further drawback is that inaccurate quantities of propellant are deposited in the chamber, thereby requiring machining operations following cure to form a rocket motor. This drawback is of particular concern where the core rods are inserted into the chamber after filling with propellant since the propellant might overflow from the chamber and spill onto the apparatus causing a hazardous condition.

The present invention was developed in order to overcome these and other drawbacks of the prior devices by providing a casting apparatus wherein a precise quantity of propellant is injected into a succession of rocket motors from the bottom, whereby voids in the propellant and secondary machining operations are avoided.

SUMMARY OF THE INVENTION

Accordingly, it is a primary object of the present invention to provide an apparatus for automatically filling rocket propulsion motors with semi-solid propellant. The apparatus includes a frame having a horizontal circular rack connected therewith. The rack vertically supports a plurality of the motors and an indexing mechanism is connected with the rack for incrementally rotating the same relative to the frame. A propellant filling apparatus is connected with the frame below the rack and a carriage cylinder is operable to raise the propellant filling apparatus to connect it with the bottom of the motor being filled. An injection cylinder is connected with the propellant filling apparatus and is operable to inject a given quantity of propellant from the propellant filling apparatus into the motor.

The propellant filling apparatus includes a tubular housing defining a fill chamber connected with a propellant supply. The injection cylinder includes a piston extensible in one end of the fill chamber. A fill valve is connected with the other end of the chamber and controls the delivery of propellant from the chamber to the motor. The degree of displacement of the cylinder piston controls the quantity of propellant injected into the motor.

According to a more specific embodiment of the invention, the injection cylinder is a variable speed hydraulic cylinder and a control device controls the operation thereof.

According to a further object of the invention, the fill valve is operated by a fill cylinder to open the valve after the valve engages the bottom of the motor. The rack preferably includes a sleeve or fixture adjacent each motor which engages a mandrel contained in the motor when the propellant filling apparatus is raised against the motor. With the fill valve opened, the force of propellant from the filling apparatus displaces the mandrel to open the bottom of the motor.

The apparatus preferably includes a clamping assembly for clamping the top of the motor during the propellant filling operation and a vacuum source is provided to create a vacuum in the motor prior to filling the motor with propellant to prevent air pockets from forming in the propellant during fill. Heated water is also circulated about the propellant fill chamber to maintain the propellant in a semi-solid state.

BRIEF DESCRIPTION OF THE FIGURES

Other objects and advantages of the invention will become apparent from a study of the following specification when viewed in the light of the accompanying drawing, in which.

DETAILED DESCRIPTION

Figure 2:
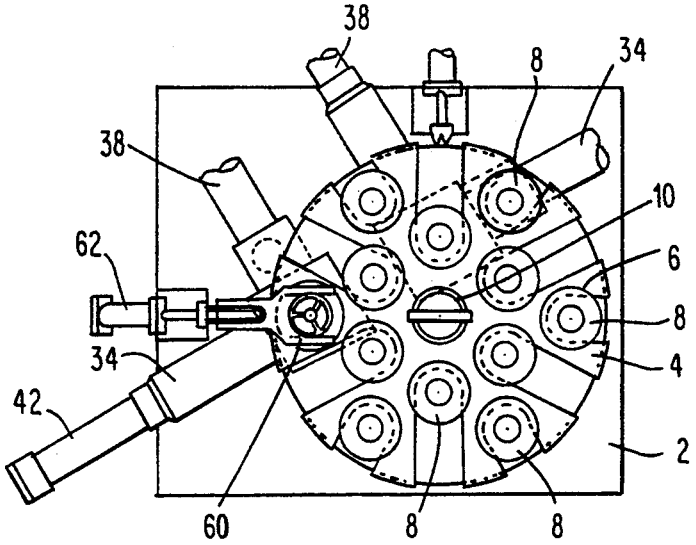
FIG. 2 is a top view of the apparatus of FIG. 1.

The propellant casting apparatus for automatically filling rocket motors with propellant according to the invention will be described first with reference to FIGS. 1 and 2. The apparatus includes a fixed frame 2 with which is connected a rotatably connected a horizontal circular rack 4 containing a plurality of openings 6 for vertically supporting a plurality of rocket motors 8, respectively. The frame includes a vertical pillar 10 which supports an upper plate 12 containing a plurality of slots 14 for receiving the upper ends of the motors to steady the same.

Figure 1:
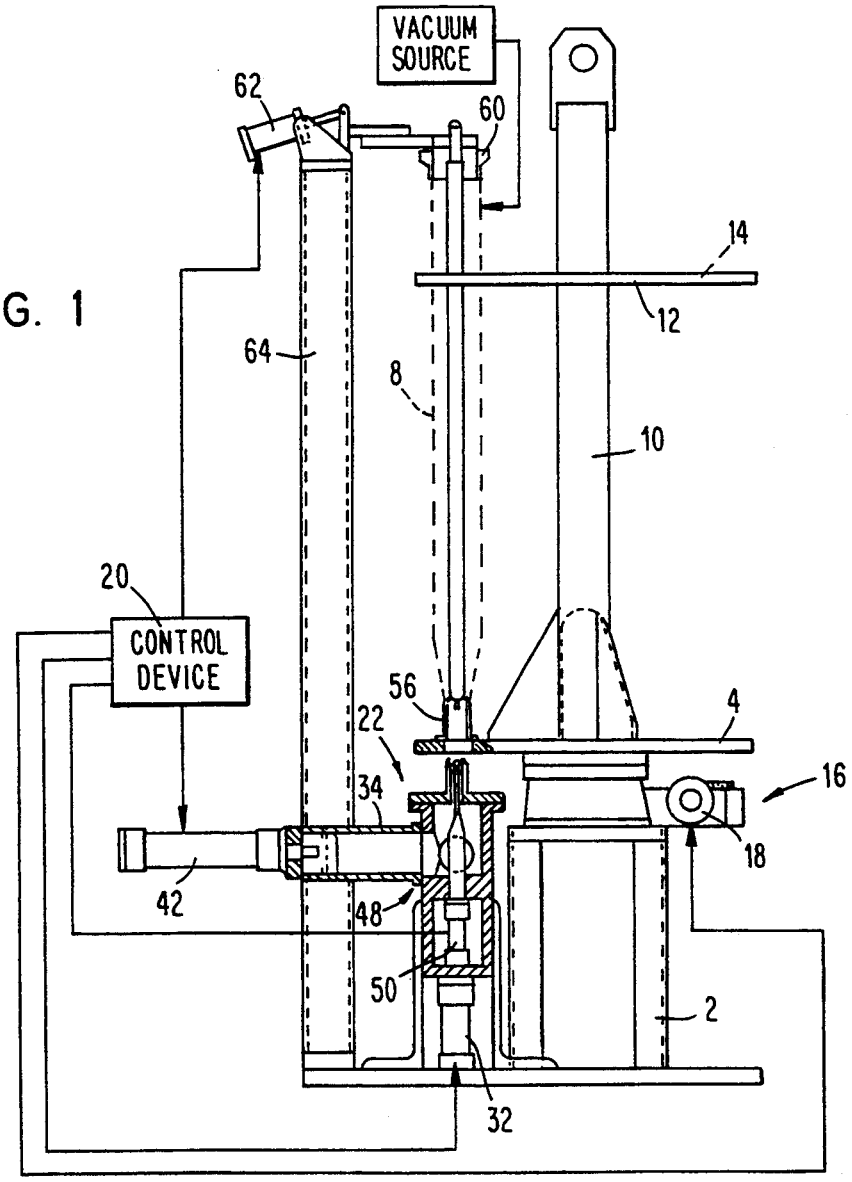
FIG. 1 is a partial side sectional view of the propellant casting apparatus according to the invention.

In the embodiment of FIGS. 1 and 2, the rack 4 contains twelve openings for supporting twelve rocket motors, with six openings being equally spaced about concentric circles in the rack as shown in FIG. 2. Corresponding slots or openings are provided in the upper plate 12. Any number of openings can be provided in the rack and plate for supporting a like number of motors in accordance with the dimensions of the plate and the diameters of the motors.

An indexing mechanism 16 is connected between the frame 2 and the rack 4 for incrementally rotating the rack. The indexing mechanism preferably comprises an indexing motor 18 whose operation is controlled by a control device 20 in a conventional manner as will be set forth in greater detail below.

Arranged beneath the rack 4 and connected with the frame 2 is the propellant filling assembly 22. Although only one filling assembly is illustrated and described, the apparatus preferably has a pair of filling assemblies, whereby two motors can be filled simultaneously.

Figure 3:
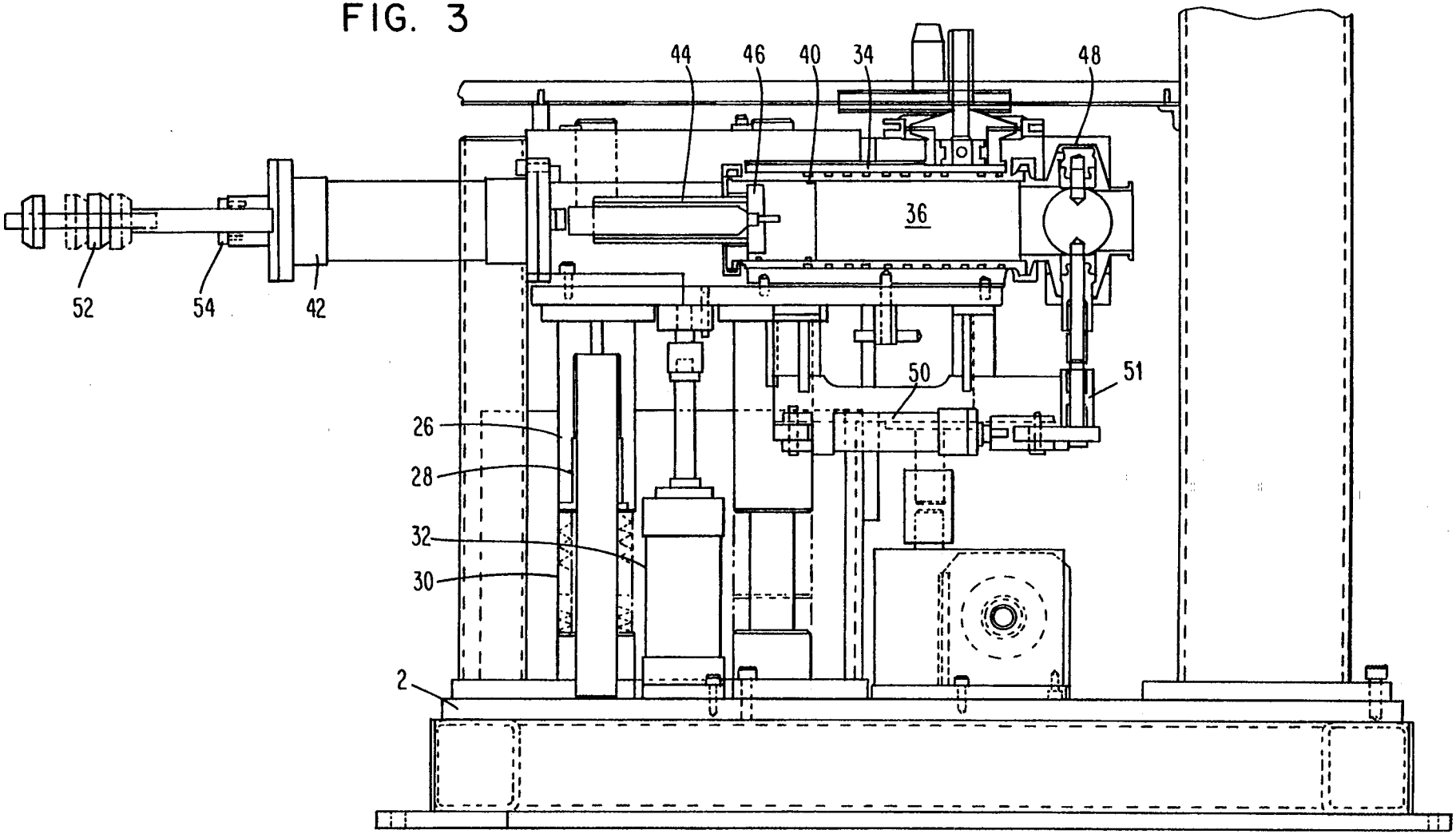
FIG. 3 is a detailed sectional view of the injection cylinder, propellant fill chamber, and fill valve according to the invention.
Figure 4:
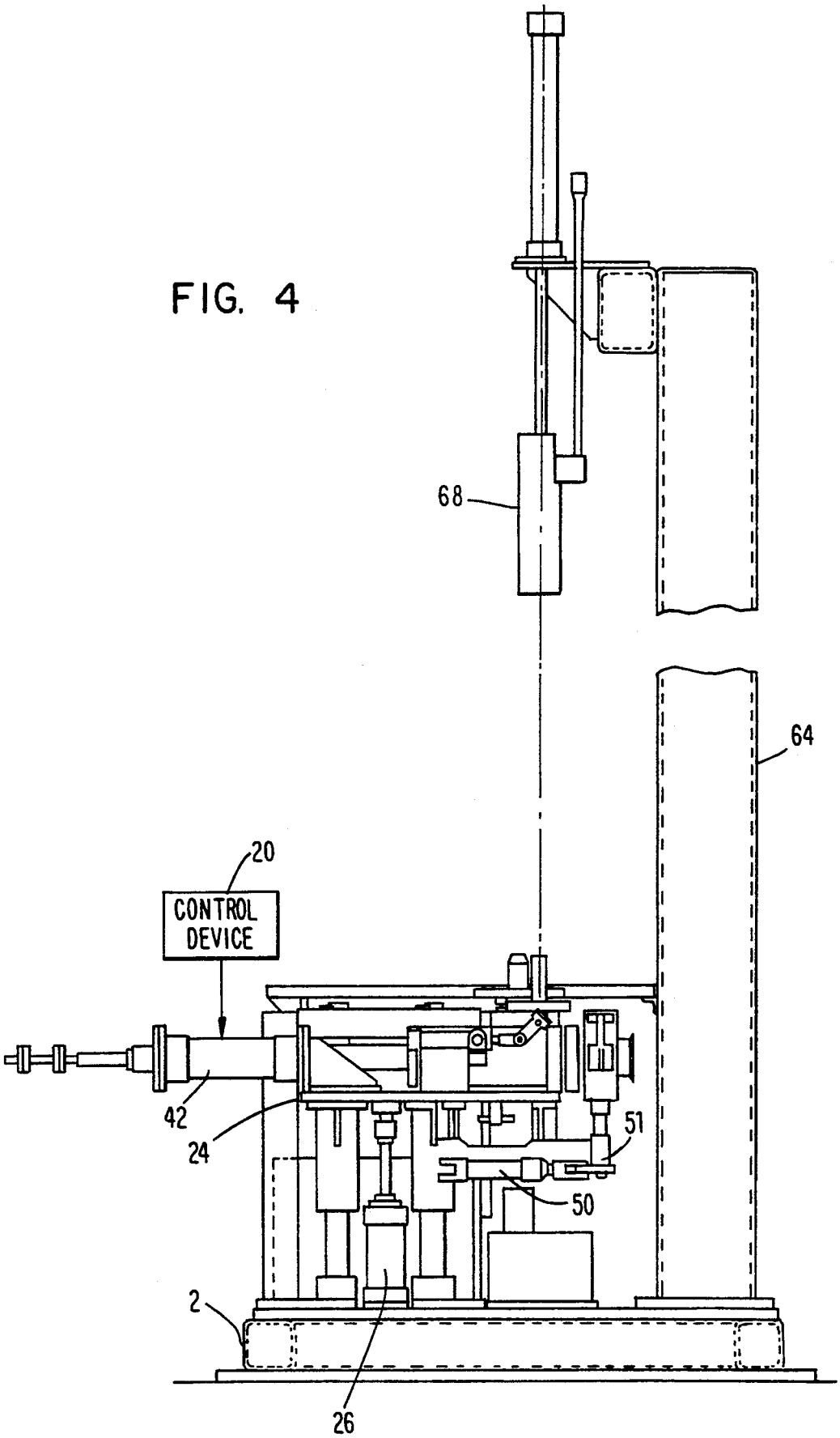
FIG. 4 is a side view of the apparatus illustrating the motor mandrel handling apparatus.

The propellant filling assembly 22 is mounted on a support carriage 24 as shown more particularly in FIGS. 3 and 4. The support carriage 24 includes vertical sleeves 26 which extend downwardly therefrom about fixed shafts 28 connected with the frame 2. Springs 30 are arranged between the sleeves and the frame to cushion the support carriage during displacement. The carriage is vertically displaceable relative to the frame by operation of a carriage cylinder 32. More particularly, the carriage cylinder 32 is operable under control of the control device to raise the propellant filling apparatus to engage the bottom of the motor to be filled. After filling, the carriage cylinder retracts for refill of the propellant filling apparatus and for incremental movement of the rack 4 by the indexing motor 18 to bring a subsequent motor into the filling position as will be set forth in greater detail below.

Referring now to FIGS. 1–3, the propellant filling assembly 22 will be described. The assembly includes a horizontal tubular housing 34 which defines a propellant fill chamber 36. A propellant supply line 38 is connected with the housing 34 for delivering propellant thereto. The propellant is a semi-solid material which flows from the propellant supply line 38 into the chamber 36, with a valve (not shown) being provided between the supply line and the chamber to control the flow of propellant.

The wall of the housing 34 contains a plurality of grooves 40 through which heated water is circulated. This elevates the temperature of the chamber 36 and maintains the propellant arranged therein in a semi-solid state.

Connected with one open end of the housing 34 is a variable speed injection cylinder 42 whose operation is also controlled by the control device 20. The injection cylinder 42 includes a piston 44 which is displaceable relative to the chamber 36. The head 46 of the piston has an outer diameter which corresponds with the inner diameter of the chamber 36. Connected with the other end of the chamber 36 is a fill valve 48, the operation of which is controlled by a fill cylinder 50. In the embodiment of FIG. 3, the fill valve comprises a butterfly valve operated by the fill cylinder 50 via a linkage assembly 51.

The filling operation of the propellant filling apparatus is as follows. With the injection cylinder piston 44 in its retracted position (FIGS. 1 and 3) and with the fill valve 48 closed, propellant is delivered to the chamber 36 and valve 48 from the propellant supply line 38. The carriage cylinder 32 is activated to raise the propellant filling assembly to engage the bottom of the motor to be filled. The fill valve 48 is then opened by the fill cylinder and the injection cylinder 42 is actuated by the control device 28 to extend its piston into the chamber 36 to inject the propellant into the motor via the fill valve. The length of travel of the injection cylinder piston determines the precise quantity of propellant injected into the motor in accordance with motor size and other design considerations. The travel or extension of the piston is accurately controlled by a switching mechanism 52 and a stop 54 connected with the injection cylinder. Because of the variable speed of operation of the injection cylinder, the filling operation can be initiated at a high rate and slowed as the motor is filled to prevent folds or voids from being formed in the propellant as it fills the motor. When the precise quantity of propellant has been injected into the motor, the fill valve is closed by the fill cylinder and the injection cylinder piston is retracted.

The rack 4 preferably includes a tubular fixture 56 as shown in FIG. 1 against which the axial mandrel 58 of the motor is seated. When the fill valve is opened to deliver the propellant to the motor, the force of the propellant displaces the mandrel upwardly to open the bottom of the motor to receive the propellant. When fill is completed and the fill valve is closed, the mandrel drops to close the bottom of the motor.

A clamp 60 is provided above the top of the motor to be filled. Prior to filling, a clamping cylinder 62 is operated (under control of the control device 20) to clamp the top of the motor with the clamp 60, thereby to prevent the motor from being jostled vertically during raising of the carriage and during the filling operation. That is, the motor is secured between the rack 4 and the clamp 60 for filling. A pylon 64 is connected with the frame 2 to suspend the clamp 60 and clamping cylinder 62 above the motor.

In order to assist in preventing the formation of voids or air pockets in the propellant during fill, a vacuum source 66 is connected with the motor to evacuate the same prior to fill.

Referring now to FIG. 4, there is shown the mandrel plunger assembly 68 connected with the pylon 64 of the frame. An air cylinder 70 controls the operation of the plunger assembly 68 to insert the mandrels into the motors prior to fill.

For smooth operation, the clamp, injection, fill, and carriage cylinders are all hydraulic. While they may be controlled manually for proper sequential operation, the automatic control device 20 increases the efficiency of the fill operation for multiple motors. The control device preferably utilizes pneumatic logic to control the sequence of operations.

The operation of the propellant casting apparatus will now be described. Empty motors are arranged in the rack 4 and held at their upper ends by the plate 12. Under control of the control device 20, the valve between the propellant supply line 38 and the fill chamber 36 is opened and the injection cylinder 42 is retracted to fill the chamber with propellant while the fill valve 48 is closed. The control device closes the supply valve and operates the clamp cylinder 62 to clamp the top of the motor being filled. Next, the carriage cylinder 32 is actuated to raise the carriage 24 to connect the fill valve 48 with the bottom of the motor being filled. Preferably, two propellant supply assemblies are provided and connected with two supply lines as shown in FIG. 2 to fill two motors simultaneously. The fill cylinder 50 is activated to open the fill cylinder 48, and the injection cylinder 42 is then activated to extend the piston 44 into the chamber 36 to inject the propellant into the motor through the fill valve. The fill valve is then closed for retracting the fill cylinder following which the carriage cylinder is retracted to lower the support carriage away from the motor. The clamp cylinder is retracted to release the filled motor, following which the indexing motor 18 is operated to incrementally rotate the rack and position the next cylinder(s) in the fill position. The sequence is then repeated until all of the motors have been filled.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. Apparatus for automatically filling rocket propulsion motors with semi-solid propellant, comprising (a) a fixed frame;

(b) a rack rotatably connected with said frame for vertically supporting a plurality of motors, each of which has a bottom;

(c) indexing means connected between said rack and said frame for incrementally rotating said rack;

(d) propellant filling apparatus connected with said frame;

(e) means for connecting said propellant filling apparatus with the bottom of at least one of the motors; and (f) means for injecting a given quantity of propellant from said propellant filling apparatus into the bottom of the motor, whereby the motors are accurately filled with the given quantity of propellant from the bottom thereof to prevent the formation of voids in the propellant.

2. Apparatus as defined in claim 1, wherein said propellant filling apparatus comprises (1) a housing defining a fill chamber, said housing being connected with a propellant supply for delivering propellant to said chamber; and (2) a fill valve connected with one end of said housing for controlling delivery of propellant to the motor, said injecting means being connected with another end of said housing.

3. Apparatus as defined in claim 2, wherein said injecting means comprises a cylinder including a piston which is extensible into said propellant fill chamber, displacement of said piston controlling the quantity of propellant injected into the motor.

4. Apparatus as defined in claim 3, wherein said injection cylinder operates at variable speeds.

5. Apparatus as defined in claim 4, and further comprising control means for controlling operation of said injection cylinder.

6. Apparatus as defined in claim 5, wherein said injection cylinder comprises a hydraulic cylinder.

7. Apparatus as defined in claim 2, wherein said fill valve comprises a butterfly valve.

8. Apparatus as defined in claim 1, and further comprising vacuum means for creating a vacuum in the motor prior to filling the motor with propellant to prevent air pockets from forming in the propellant during fill.

9. Apparatus for automatically filling rocket propulsion motors with semi-solid propellant, comprising (a) a fixed frame;

(b) a rack rotatably connected with said frame for vertically supporting a plurality of the motors, each of which has a bottom;

(c) indexing means connected between said rack and said frame for incrementally rotating said rack;

(d) propellant filling apparatus connected with said frame and including (1) a housing defining a fill chamber, said housing being connected with a propellant supply for deliverying propellant to said chamber; and (2) a fill valve connected with one end of said housing for controlling delivery of propellant to the motor;

(e) a carriage cylinder for raising said fill valve into engagement with the bottom of at least one of the motors; and (f) means for injecting a given quantity of propellant from said housing into the bottom of the motor, whereby the motors are accurately filled with the given quantity of propellant.

10. Apparatus as defined in claim 9, and further comprising a fill cylinder connected with said fill valve for opening said valve after said valve engages the bottom of the motor.

11. Apparatus as defined in claim 10, wherein said rack includes means for engaging an axial mandrel contained in the motor, the force of propellant from said filling apparatus displacing the mandrel to open the bottom of the motor.

12. Apparatus for automatically filling rocket propulsion motors with semi-solid propellant, comprising (a) a fixed frame;

(b) a rack rotatably connected with said frame for vertically supporting a plurality of the motors, each of which has a bottom;

(c) indexing means connected between said rack and said frame for incrementally rotating said rack;

(d) propellant filling apparatus connected with said frame;

(e) means for connecting said propellant filling apparatus with the bottom of at least one of the motors;

(f) means for injecting a given quantity of propellant from said propellant filling apparatus into the motor, whereby the motors are accurately filled with the given quantity of propellant;

(g) means for clamping the top of the motor during the filling operation.

13. Apparatus for automatically filling rocket propulsion motors with semi-solid propellant, comprising (a) a fixed frame;

(b) a rack rotatably connected with said frame for vertically supporting a plurality of the motors each of which has a bottom;

(c) indexing means connected between said rack and said frame for incrementally rotating said rack;

(d) propellant filling apparatus connected with said frame including (1) a housing defining a fill chamber, said housing being connected with a propellant supply for delivering propellant to said chamber;

(2) a fill valve connected with one end of said housing for controlling delivery of propellant to the motor; and (3) means for heating said propellant fill chamber to maintain the propellant in a semi-solid state;

(e) means for connecting said propellant filling apparatus with the bottom of at least one of the motors; and (f) means for injecting a given quantity of propellant from said propellant filling apparatus into the bottom of the motor, whereby the motors are accurately filled with the given quantity of propellant.

* * * * *